United States Patent [19]

Graham et al.

[11] Patent Number: 4,488,599

[45] **Date of Patent: * Dec. 18, 1984**

[54] METHOD OF CONTROLLING DISPLACEMENT OF PROPPING AGENT IN FRACTURING TREATMENTS

[75] Inventors: Robert L. Graham, Baytown; Steven R. Erbstoesser, Missouri City, both of Tex.

[73] Assignee: Exxon Production Research Co., Houston, Tex.

[ * ] Notice: The portion of the term of this patent subsequent to Dec. 20, 2000 has been disclaimed.

[21] Appl. No.: 516,074

[22] Filed: Jul. 22, 1983

Related U.S. Application Data

[63] Continuation-in-part of Ser. No. 412,671, Aug. 30, 1982, Pat. No. 4,421,167, which is a continuation of Ser. No. 204,103, Nov. 5, 1980, abandoned.

[51] Int. Cl.[3] ..... E21B 33/13; E21B 43/267; E21B 47/06

[52] U.S. Cl. ..... 166/255; 166/281; 166/284

[58] Field of Search ..... 166/255, 259, 271, 280, 166/281, 284, 308

[56] References Cited

U.S. PATENT DOCUMENTS

| | | | |
|---|---|---|---|
| 2,699,212 | 1/1955 | Dismukes | 166/280 |
| 2,754,910 | 7/1956 | Derrick et al. | 166/284 |
| 3,028,914 | 4/1962 | Flickinger | 166/284 |
| 3,174,546 | 3/1965 | Flickinger | 166/308 |
| 3,384,176 | 5/1968 | Huitt | 166/308 |
| 3,482,633 | 12/1969 | Stipp et al. | 166/284 |
| 4,102,401 | 7/1978 | Erbstoesser | 166/284 |
| 4,139,060 | 2/1979 | Muecke et al. | 166/281 |
| 4,194,566 | 3/1980 | Maly | 166/308 |
| 4,195,690 | 4/1980 | Erbstoesser et al. | 166/284 |
| 4,421,167 | 12/1983 | Erbstoesser et al. | 166/281 X |

FOREIGN PATENT DOCUMENTS

| | | | |
|---|---|---|---|
| 147156 | 10/1962 | U.S.S.R. | 166/308 |

OTHER PUBLICATIONS

"A Continuous Multistage Fracturing Technique", *Journal of Petroleum Technology*, Jun. 1965, pp. 614–625.

Coburn, "Unlimited-Limited Entry", *The Oil and Gas Journal*, vol. 61, No. 10, Mar. 11, 1963, pp. 88–92.

*Primary Examiner*—George A. Suchfield

*Attorney, Agent, or Firm*—Richard F. Phillips

[57] ABSTRACT

A method of preventing overdisplacement and underdisplacement of proppant during well treatments to hydraulically induce and maintain a fracture in a subterranean formation traversed by a wellbore having a perforated casing. In the practice of the method, ball sealers are incorporated in the trailing end portion of a fracturing fluid-proppant slurry. The ball sealers have a density such that they do not sink in the slurry nor rise in the displacement fluid injected following the slurry. The ball sealers seat on at least some of the well perforations as the final portion of the slurry reaches the perforations. This causes the surface pumping pressure to increase, signalling the end of the treating operation. The detection of the time at which a selected portion of the injected fluid reaches the perforations allows the treatment to be terminated, minimizing proppant overdisplacement and providing for a fully packed fracture in the near-wellbore region. In another embodiment of the method, slurries of different densities are utilized, with the ball sealers having a density such that they remain at the interface between the slurries during the injection process.

8 Claims, 3 Drawing Figures

METHOD OF CONTROLLING DISPLACEMENT OF PROPPING AGENT IN FRACTURING TREATMENTS

CROSS REFERENCE TO RELATED APPLICATIONS

This application is a continuation-in-part of patent application Ser. No. 412,671, filed Aug. 30, 1982, now U.S. Pat. No. 4,421,167. Patent application Ser. No. 412,671 is a continuation of U.S. Patent application Ser. No. 204,103, filed Nov. 5, 1980, now abandoned.

BACKGROUND OF THE INVENTION

1. Field of the Invention

This invention relates to the treatment of oil wells, gas wells, injection wells and similar boreholes. In one aspect it relates to a method of stimulating the productivity of hydrocarbon-bearing formations by hydraulic fracturing techniques. In a more specific aspect, it relates to a method for terminating a fracturing-propping treatment when a selected portion of the injected treatment fluid reaches the perforations through which the treatment fluid enters the formation. Use of this method prevents overdisplacement and underdisplacement of propping agent particles in hydraulic fracturing treatment.

2. Description of the Prior Art

A common technique for stimulating the productivity or injectivity of subterranean formations traversed by a borehole involves a treatment known as hydraulic fracturing. In this treatment, a fluid is injected through the well and into the formation at a sufficiently great pressure and rate to cause the formation to fail in tension. This establishes cracks, commonly termed "fractures", in the formation. The earth stresses are normally such that the resulting fractures are vertical, extending in opposite directions from the well. The fracture can be extended several hundred feet into the formation, depending upon the volume and properties of the treating fluid and the nature of the formation. The fracture is normally propped open by means of particles known as propping agents. These particles are also referred to as "proppant". The propping agent is carried down the well and into the formation as a suspension in the fracturing fluid. The propping agent-treating fluid mixture is often referred to as a "proppant slurry". THe injection of proppant-bearing fluid is typically followed with the injection of proppant-free displacement fluid. As will be detailed below, the injection of this displacement fluid is preferably terminated as the last of the proppant reaches the perforations.

As the fracturing fluid bleeds off into the formation, the propping agent is deposited in the fracture. Upon the release of the fluid pressure, the fracture walls close upon the propping agent. The propping agent prevents the fracture from completely closing, thereby maintaining a channel in the formation which is conducive to fluid flow. If properly performed, the hydraulic fracturing treatment can increase the productivity of a well several fold.

A problem associated with the placement of the propping agent in a fracture is that of overdisplacement. As pointed out in SPE Paper 3030 "Stresses and Displacements Around Hydraulic Fractured Wells" published by the Society of Petroleum Engineers of the AIME in 1970, the tendency of a fracture to close in the near-wellbore region can greatly affect productivity. If the fracture is not completely filled with propping agent in the near wellbore region, the productivity of the well will be greatly reduced relative to what it would have been had an adequate amount of proppant remained in that portion of the fracture nearest the wellbore. This overdisplacement of proppant occurs when fluid not containing proppant is forced into the fractures. This proppant-free fluid tends to displace the proppant existing in the fracture to a position away from the wellbore. This leaves the near-wellbore region depleted in proppant. Studies have shown that the stress level in this region causes the fracture to close upon incomplete fracture fill-up, reducing the effectiveness of the treatment.

On the other hand, if too large a volume of propping agent is used, excess propping agent will settle in the wellbore. If the amount of excess propping agent is sufficiently great, it can occupy the wellbore to a level above the perforations, causing a reduction in well productivity. To remedy this situation, an expensive sand washing operation is generally required.

The normal technique for preventing overdisplacement of the slurry is to carefully monitor the volume of fluid pumped into the well so that upon injection of the proper volume of displacement fluid, the pumping operations are terminated. The proper displacement volume is based upon tubular volume calculations. However, the instruments, including flowmeters, tank strapping techniques, etc., used to measure the total volume of displacement fluid are not precise. Because of the inherent inaccuracies in these instruments, the monitoring technique often does not prevent underdisplacement or overdisplacement of proppant in the fractures.

SUMMARY OF THE INVENTION

The present invention provides a simple technique which positively prevents the overdisplacement or underdisplacement of propping agent. It has been discovered that by incorporating ball sealers of controlled density in a trailing end portion of a fluid carrying the propping agent to the fracture, the ball sealers will remain adjacent the last of the proppant and, upon reaching the perforated interval, the ball sealers will seat on and close the perforations, thereby preventing overdisplacement. With the ball sealers positioned at the end of the slurry, injection continues until little or no proppant remains in the wellbore, thereby preventing underdisplacement. In a preferred embodiment, wherein a displacement fluid is used to flush the fracturing fluid through the well tubulars, ball sealers are selected to have a density less than or equal to that of the fracturing fluid but greater than that of the displacing fluid. In another embodiment, wherein the fracturing fluid and the displacing fluid are the same, the ball sealers are selected to have a density less than that of the slurry but greater than that of the fracturing fluid. During transport in the first embodiment the ball sealers will be maintained at the interface (or transition region) between the fracturing fluid and the displacement fluid. If the fracturing fluid and the displacement fluid are the same, the ball sealers will be maintained at the slurry/-displacement fluid transition region. The displacement fluid may be free of proppant or may contain proppant in an amount such that the density of the displacement slurry is less than that of the slurry carrying the main proppant flow.

This use of ball sealers is further advantageous in that as the ball sealers seat the resistance of the wellbore to continued pumping of the displacing fluid is increased. The resistance of the wellbore to pumping can be monitored to serve as an indicator of when the ball sealers, and hence the last of the proppant, reaches the perforations. This permits proppant displacement to be terminated at a precisely selected point in the treatment operation.

BRIEF DESCRIPTION OF THE DRAWINGS

For a better understanding of the present invention, reference may be made to the accompanying drawings which.

DESCRIPTION OF THE PREFERRED EMBODIMENT

Figure 1:
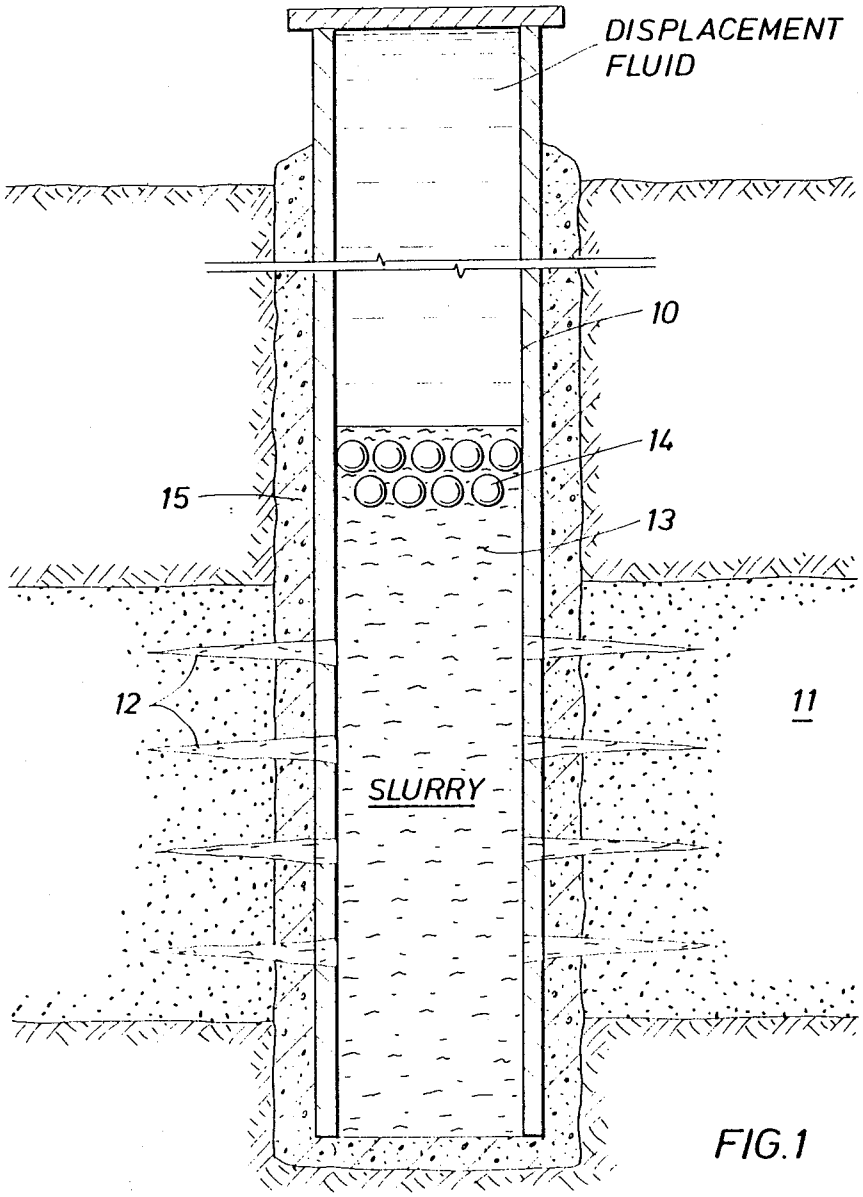
FIG. 1 is a schematic showing the relative position of the ball sealers at the transition region between a fracturing fluid and the displacement fluid during transport down the well tubulars.

The present invention is specifically adapted for use in hydraulic fracturing of oil wells, gas wells, water wells and injection wells. Referring to FIG. 1, such wells are normally provided with casing 10 which extends from the surface through a formation 11 which it is desired to fracture. The casing 10, cemented in place, is provided with a plurality of perforations 12 which penetrate the casing 10 and the cement sheath 15 surrounding the casing 10. The perforations 12 establish fluid communication between the formation 11 and the well.

In order to stimulate the productivity of the well, it is in many instances necessary to fracture the formation 11. This is accomplished by injecting a fracturing fluid down the casing 10 through the perforations 12 and into the formation 11. (In fracturing operations, the fluid is usually injected through a tubular string positioned inside the casing. For purposes of describing this invention, however, it is not necessary to illustrate the tubing.) The injection is conducted at a rate and pressure adequate to cause the formation to fracture, forming radially outwardly extending fractures. Once the fracture is initiated, a carrier fluid is used to transport propping agent particles such as sand, glass beads, or ceramic proppants into the fracture. The terms "fracturing fluid" and "carrier fluid" are used interchangeably herein. The propping agent particles are illustrated as short irregular lines 13 in the drawing. The slurry of carrier fluid and propping agent is flushed down the casing 10 (or the tubing, if used) and into the perforations 12 by means of a displacement fluid. As mentioned previously, it is important to avoid overdisplacement of the propping agent and away from the near wellbore region.

In accordance with the present invention, ball sealers 14 are incorporated in the trailing portion of the carrier fluid. The density of the ball sealers 14 is controlled to prevent them from settling in the carrier fluid-propant slurry. Ball sealers have long been used as diverting agents, but have not been used to prevent overdisplacement of propping agent particles in the manner described herein. Ball sealers are generally spherical, having a diameter ranging from about ⅝ inches (1.59 cm) to about 1⅛ inches (2.86 cm). They may be composed of resinous material such as nylon or syntactic foam and may have deformable covers of plastic or elastomer to aid in the sealing of perforations. The density of ball sealers normally range from about 0.8 to about 1.9 g/cm$^3$. A particularly suitable ball sealer for use in the present invention is a rubber-coated syntactic foam ball sealer described in U.S. Pat. No. 4,102,401.

The type of ball sealers chosen for a particular application will depend upon the fluid system used in the treatment. The density of the ball sealers 14 is selected to prevent settling in the slurry and rising in the displacement fluid. The ball sealers 14 may have a density less than or equal to that of the fracturing fluid-proppant agent slurry but greater than the displacing fluid. Preferably the ball sealers 14 should be at or adjacent the interface between the slurry and the displacement fluid at the time this interface reaches the perforations 12.

The fracturing fluid may be any of those presently used including water-based, oil-based, and emulsion fluids having densities between 6.5 pounds per gallon (777.9 gm/l) and 10.0 pounds per gallon (1197 gm/l). The displacement fluid frequently is a gas or a hydrocarbon liquid such as diesel or lease crude to facilitate establishing initial production following treatment. However, water or the fracturing fluid itself may also be used as the displacing fluid.

Any propping agent 13 may be used in the practice of the present invention. Sand is by far the most common, but glass beads, resin particles, and ceramic proppants are frequently used proppants. The particle size normally ranges from 10 mesh to 80 mesh with 20–40 mesh being the most common. The concentration of the proppant particles 13 in the carrier fluid also may vary within a relatively broad range. For a normal fracturing treatment the overall average of proppant concentration is usually between 1 and 3 pounds per gallon (119.7 to 359 gm/l); however during the treatment proppant concentration is often in the range of from 3 to 5 pounds per gallon (359 to 598.4 gm/l), and in certain special applications can be 6 pounds per gallon (718.1 gm/l) and above.

The following laboratory test demonstrates that ball sealers heavier than a fluid will exhibit buoyancy in a sand suspension of that fluid. A 4-foot (121.9 cm) section of 2-inch (5.1 cm) lucite tube closed at one end was filled with water having a density of 8.3 pounds per gallon (993.4 gm/l) and 20–40 mesh sand was added to provide a sand concentration equivalent to 8.7 pounds of sand per gallon (1041.2 gm/l). Syntactic foam-cored and nylon-cored ball sealers, having densities of 1.01 and 1.11 g/cm$^3$, respectively, were then introduced into the tube. The top of the tube was closed. The tube was agitated to disperse the sand and the ball sealers. When the agitation was stopped the ball sealers tended to rise to the top of the slurry. The ball sealers remained in the upper portion of the slurry as the sand settled within the tube.

Figure 2:
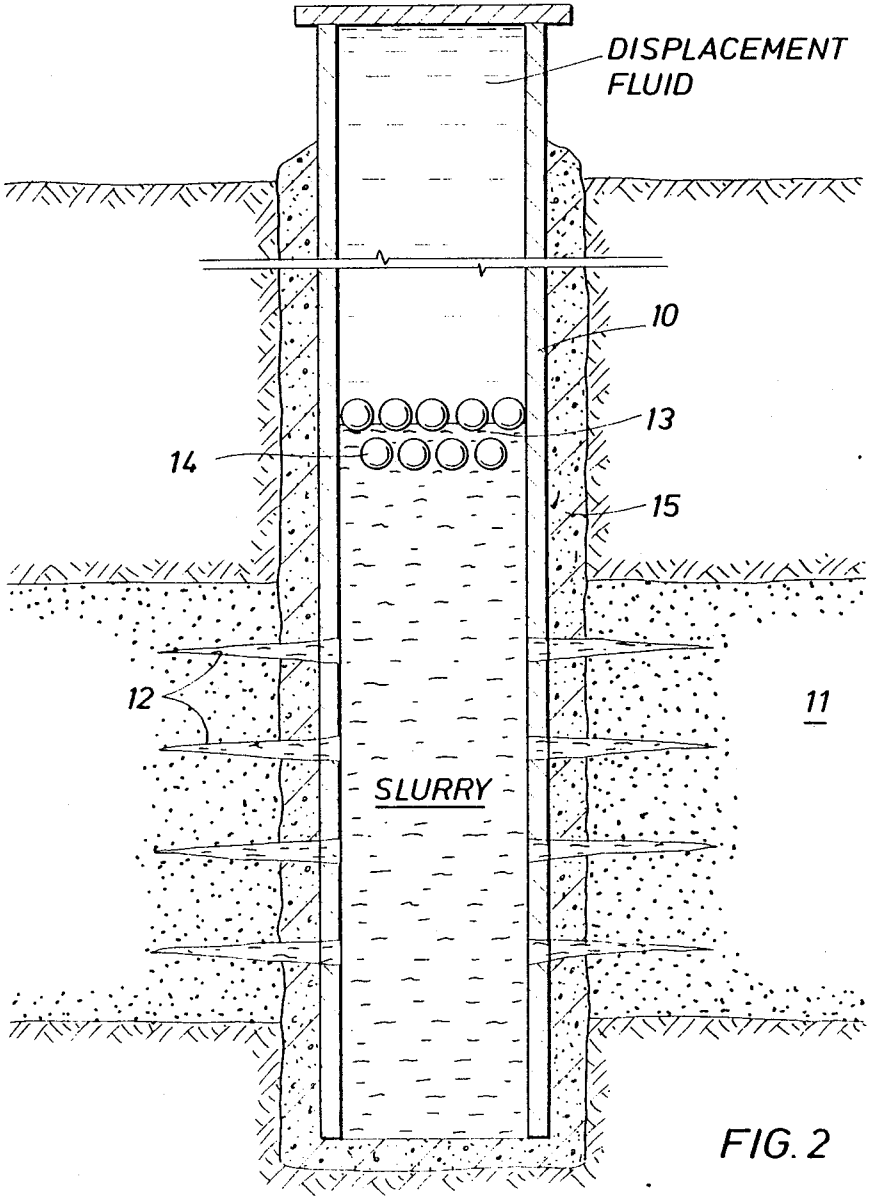
FIG. 2 is a schematic similar to FIG. 1 showing the ball sealers being transported at the transition region between a slurry and displacement fluid.

In carrying out the treatment according to the present invention, the fracturing operation may be performed in the conventional manner employing the desired amounts of fracturing fluid and proppant. In many instances a pad volume free of proppant is used to initiate the fracture. Following this, the carrier fluid is used to transport the propping agent 13 into the fracture. The pad volume and the carrier fluid can be the same. During the final stages of blending the propping agent into the slurry at the surface, a plurality of ball sealers 14 (usually in excess of the number of perforations in the well) are incorporated in batch form into the slurry along with the propping agent or immediately following the propping agent. If a displacing fluid is used, it normally will have a density equal to or less than that of the fracturing fluid. If the density is less, the ball sealers 14 are preferably selected to have a density intermediate that of the fracturing fluid and displacement fluid. The ball sealers 14 will thus tend to collect at the interface or transition region as shown in FIG. 1. If the density of the displacing fluid is about equal to that of the fracturing fluid or if the fracturing fluid itself is used as the displacing fluid, as shown in FIG. 2, the ball sealers 14 should be selected to have a density slightly greater than that of the fracturing fluid but less than that of the fracturing fluid-proppant slurry. As demonstrated in the laboratory experiment described above, ball sealers of correctly selected density will not settle in the slurry but will remain in the trailing end portion thereof.

Injectors are available for placing the ball sealers 14 in the stream at the proper time. Ideally, the ball sealers 14 may be positioned in a by-pass injection line which may be activated at the proper time by directing the flow through the injector line, causing all of the ball sealers 14 to be introduced into the well at once.

During transport down the well, the ball sealers 14 will remain proximate the trailing fluid portion of the slurry. As the trailing portion of the slurry approaches the perforations 12, the ball sealers 14 will seat on the perforations 12 closing off the flow therethrough. Since the ball sealers 14 remain proximate the trailing portion of the proppant slurry, the sealing will occur before the displacement fluid can overdisplace the proppant in the fractures. As the ball sealers 14 seat on the perforations, the surface pumping pressure will increase, signaling the end of the treating operation. Ideally, all of the perforations 12 will be sealed because an excess number of the ball sealers 14 is used. However, because some of the perforations 12 may not be receiving fluid, it is possible that a small number of the perforations may not be sealed. This, however, should be of no consequence because over-displacement would not be a problem in these perforations.

In the practice of one embodiment of the present invention, the resistance of the wellbore to receiving fluid injection is monitored during the course of the treatment. Monitoring of injection resistance (pumping resistance) can be accomplished in numerous manners familiar to those skilled in the art: for example, by monitoring the pressure in a constant flow rate injection; by monitoring the flow rate in a constant pressure injection; and by monitoring pump power requirements in a constant flow rate injection. As the ball sealers 14 seat on the perforations 12, the pumping resistance will increase significantly. This will occur when that portion of the treating fluid with which the ball sealers 14 were injected reaches the perforations 12. In response to detection of this increased resistance to fluid injection, the injection can be terminated. Those skilled in the art of the use of ball sealers will readily recognize techniques for distinguishing increases in injection resistance caused by the seating of ball sealers from increases in pumping resistance resulting from other causes. Most typically, such increases are detected by monitoring the pumping pressure in the course of a constant flow rate treatment and detecting. Seating of the ball sealers 14 typically results in a significant pressure increase over a relatively short time span. Pressure increases resulting from other causes in treatment operations are typically much less rapid than those resulting from the sealing of ball sealers.

Figure 3:
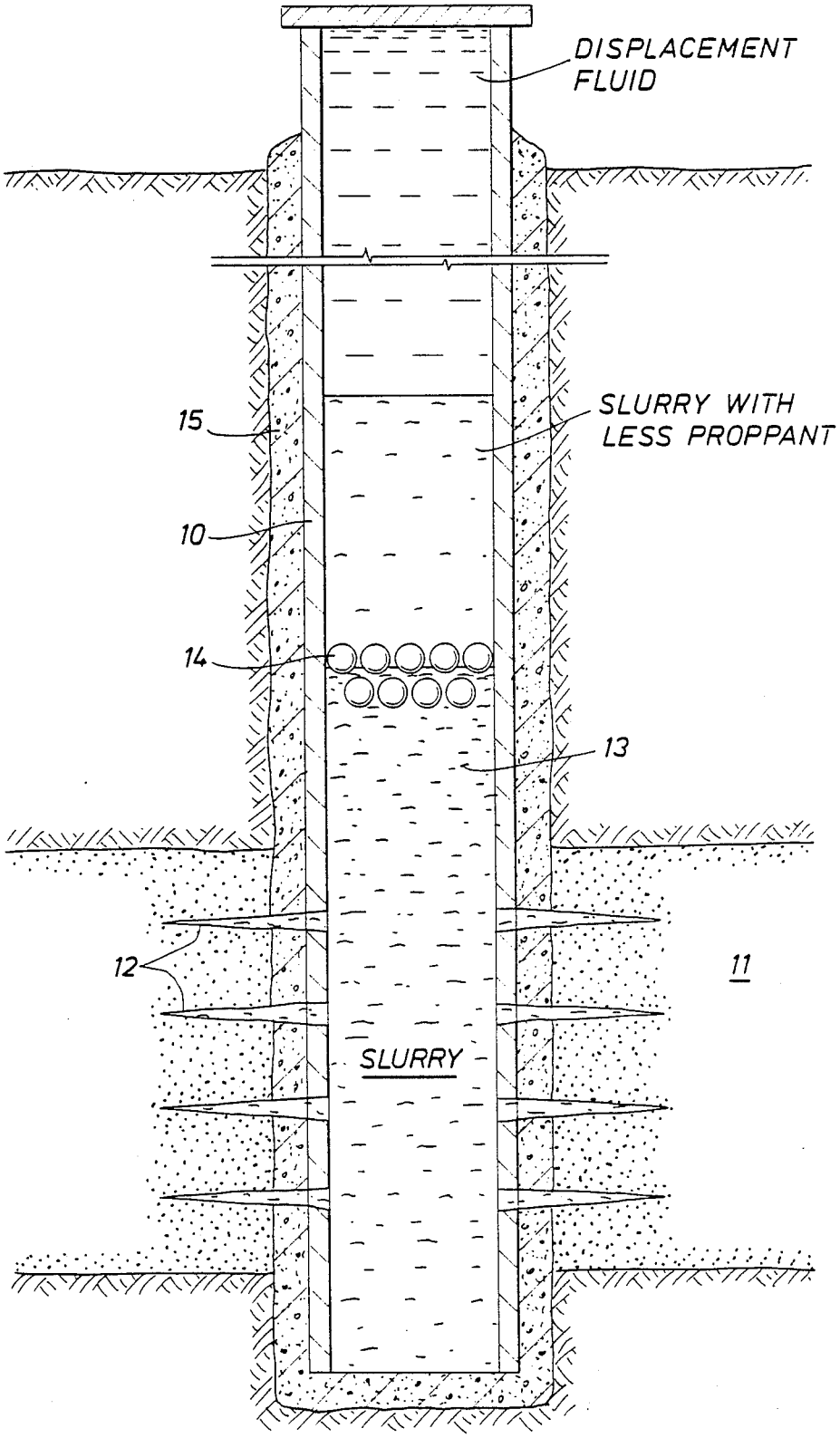
FIG. 3 is a schematic similar to FIGS. 1 and 2 showing the ball sealers being transported at a transition region between a slurry of a first density, and a slurry of a second lesser density.

In another embodiment of the present invention, illustrated in FIG. 3, proppant-treating fluid slurries of different densities are utilized in the course of the treating operation. Ball sealers 14 are injected at the interface between the slurries. The ball sealers 14 are preferably of a density intermediate the densities of the two slurries, but alternatively may have a density equal to that of either of the two slurries. Preferably, the second of the two slurries has a lower volume amount of proppant than does the first slurry. In this embodiment of the present invention, limited underflush will occur since that portion of the proppant in the second slurry will remain in the wellbore at the time the ball sealers 14 seal on the perforations. However, this remaining proppant is generally not undesirable since its existence in the well in the final stages of injection prevents localized overflush which otherwise could occur from leakage past a ball sealer 14 prior to termination of the injection. The volume of the second slurry is preferably selected to be sufficiently small as to preclude the amount of proppant deposited in the well from causing any problems.

As can be seen by the foregoing description, the invention provides a simple but positive method for preventing the overdisplacement or underdisplacement of propping agent in fractures. While certain embodiments and applications of this invention have been shown and described, it will be apparent to those skilled in the art that many more modifications are possible without departing from the inventive concepts herein described. The invention, therefore, is not to be restricted except as is necessary by the prior art and by the spirit of the appended claims.

What is claimed is:

1. A method of stimulating the productivity of a subterranean formation surrounding a casing having perforations formed therein, the method comprising the steps of:

injecting into said formation through the perforations a slurry of fracturing fluid and propping agent particles at a pressure and rate sufficient to generate a fracture in said formation;

incorporating ball sealers into a trailing end portion of said slurry, said ball sealers having a density such that the ball sealers do not settle in the slurry; and pumping a fluid down the well to displace the trailing end portion of said slurry from the surface to the perforations, said displacing fluid having a density such that the ball sealers do not rise in the displacing fluid;

monitoring the resistance to pumping of said displacing fluid; and, terminating the pumping of said displacing fluid in response to detection of an increase in the resistance to pumping of said displacing fluid indicative of seating of at least some of the ball sealers on the perforations.

2. The method as set forth in claim 1 further comprising the step of terminating all surface pumping operations in response to detection of an increase in the resistance to pumping of said displacing fluid indicative of seating of at least some of the ball sealers on the perforations.

3. A method for controlling the displacement of propping agent in the fracturing treatment of a cased well, said cased well having an interval with a plurality of perforations therethrough, said propping agent being carried through said perforation by fluid flow through said cased well, said method comprising the steps of:

pumping into the well a carrier fluid bearing a propping agent, said mixture of carrier fluid and propping agent being of a first density;

incorporating ball sealers at a point in the fluid flow substantially adjacent a trailing portion of the carrier fluid and propping agent mixture;

injecting into said well a displacing fluid, said displacing fluid being of a second density, and said ball sealers having a density in the range of from said first density to said second density;

monitoring the resistance of the well to injection of the displacing fluid; and terminating the injection of said displacing fluid in response to the detection of an increase in the resistance of the well to injection of said displacing fluid, said increase being of a nature indicative of seating of at least some of said ball sealers in said perforations.

4. The method as set forth in claim 3 wherein said first density is greater than said second density.

5. A single-stage method for fracturing a selected formation traversed by a cased well, said cased well being perforated at said selected formation, and for injecting a propping agent into the resulting fracture in a manner adapted for substantially preventing overdisplacement or underdisplacement of said propping agent, said method comprising the steps of:

injecting a pad volume into the well to initiate the fracture;

injecting a propping agent-carrier fluid slurry into the well;

injecting ball sealers proximate a trailing end portion of said propping agent-carrier fluid slurry, said ball sealers having a density such that said ball sealers do not settle in said slurry, and said ball sealers being adapted to seat on said perforations;

injecting a displacing fluid, said displacing fluid having a density such that said ball sealers do not rise in said displacing fluid;

monitoring the resistance of said cased well to the injection of said displacing fluid; and terminating the injection of said displacing fluid in response to the detection of an increase in the resistance to injection of said displacing fluid, said increase in the resistance to injection being of a nature signalling the seating of at least some of said ball sealers on said perforations.

6. A method for fracturing a selected formation traversed by a cased well, said cased well being perforated at said selected formation, and for injecting a propping agent into the resulting fracture in a manner adapted for preventing overdisplacement and underdisplacement of said propping agent, said method comprising the steps of:

injecting a first propping agent-carrier fluid slurry into the well;

injecting ball sealers proximate a trailing end portion of said first propping agent-carrier fluid slurry, said ball sealers having a density such that said ball sealers do not settle in said first slurry, said ball sealers being adapted to seat on said perforations;

injecting a second propping agent-carrier fluid slurry into the well, said second propping agent-carrier fluid slurry having a density such that said ball sealers do not rise in said second slurry;

monitoring the resistance of said cased well to the continued injection of fluid into said well, and terminating the continued injection of fluid into said well in response to the detection of an increase in resistance to continued fluid injection, said increase being of a nature resulting from seating of at least some of said ball sealers on said perforations.

7. The method as set forth in claim 6 wherein the step of injecting the second slurry is followed by a step of injecting a displacing fluid being substantially free of propping agent.

8. The method as set forth in claim 6 wherein said first slurry contains a greater density of proppant than does said second slurry.

* * * * *